US005799270A

United States Patent [19]

Hasegawa

[11] Patent Number: 5,799,270

[45] Date of Patent: Aug. 25, 1998

[54] SPEECH CODING SYSTEM WHICH USES MPEG/AUDIO LAYER III ENCODING ALGORITHM

[75] Inventor: Satoshi Hasegawa, Tokyo, Japan

[73] Assignee: NEC Corporation, Tokyo, Japan

[21] Appl. No.: 569,737

[22] Filed: Dec. 8, 1995

[30] Foreign Application Priority Data

Dec. 8, 1994 [JP] Japan ..... 6-304941

[51] Int. Cl.[6] ..... G10L 3/02

[52] U.S. Cl. ..... 704/205; 704/204; 704/203; 704/225; 704/229

[58] Field of Search ..... 395/2.38, 2.39, 395/2.28, 2.13, 2.14, 2.15; 704/203, 225

[56] References Cited

U.S. PATENT DOCUMENTS

| | | | |
|---|---|---|---|
| 5,260,980 | 11/1993 | Akagiri et al. | 375/122 |
| 5,264,846 | 11/1993 | Oikawa | 341/76 |
| 5,285,498 | 2/1994 | Johnston | 381/2 |
| 5,471,558 | 11/1995 | Tsutsui | 395/2.28 |
| 5,481,614 | 1/1996 | Johnston | 381/2 |
| 5,490,170 | 2/1996 | Akagiri et al. | 375/122 |
| 5,502,789 | 3/1996 | Akagiri | 395/2.13 |
| 5,581,654 | 12/1996 | Tsutsui | 395/2.39 |
| 5,590,108 | 12/1996 | Mitsuno et al. | 369/59 |
| 5,633,980 | 5/1997 | Ozawa | 395/2.31 |
| 5,634,082 | 5/1997 | Shimoyoshi et al. | 395/2.38 |

*Primary Examiner*—David R. Hudspeth
*Assistant Examiner*—Vijay B. Chawan
*Attorney, Agent, or Firm*—Foley & Lardner

[57] ABSTRACT

A speech coding system is shown, which comprises a linear transform unit 50 for executing linear transform on an input signal Si with a predetermined block length Sb and an FFT unit 10, 30 for executing Fast Fourier transform on the input signal Si with two different, i.e., large and small, block lengths, a block length setting unit 20 for calculating a predetermined block length Sb to be set in the linear transform unit 50 according to an FFT signal generated in the FFT unit 10, 30 and setting this block length in the linear transform unit 50, and a coding unit 80 for coding an intermediate signal Sm generated in the linear transform unit 50 to form and output a bit stream So. The FFT unit has a function of selecting a block length used for the Fast Fourier transform among two, i.e., large and small, block lengths according to a continuous portion of the input signal Si.

13 Claims, 5 Drawing Sheets

SPEECH CODING SYSTEM WHICH USES MPEG/AUDIO LAYER III ENCODING ALGORITHM

BACKGROUND OF THE INVENTION

The present invention relates to speech coding systems and, more particularly, to speech coding system conforming to layer III standardized algorithm.

Standardization of the coding techniques for transmitting or storing analog speech signal faithfully to an original speech, has been promoted by CCITT (Committee of Consultation of International Telephone and Telegraph) and the like. Among powerful algorithms of the techniques are a sub-band coding system and an adaptive transform coding system. These coding systems are common in that they utilize signal energy that is partially found in a band which far surpasses the speech signal band for improving the coding efficiency. In the sub-band coding system, the input signal is divided into a plurality of sub-bands for bit assignment in correspondence to the signal energy of each sub-band. In the adaptive transform coding system, the input signal is subjected to linear transform for quantizing the signal in a state of enhanced power concentration. For the linear transform, Fourier transform or cosine transform is usually adopted.

In the side-band and adaptive transform coding systems, it is possible to improve the overall coding quality by utilizing commonly termed psychoacoustic characteristics. A method of utilizing the psychoacoustic characteristics, is to execute a certain type of weighting (psychoacoustic weighting) when the quantizing signal in order to minimize deterioration of the signal in the frequency band that is readily sensible by the person. The psychoacoustic weighting is to determine successive corrected audible threshold values from a relative audible threshold value that is determined by the relation between an absolute audible threshold value (the threshold value here being related to the sound pressure) and a masking effect. The bit assignment is made according to the result of the weighting.

A prior art example will now be described in detail. A person can sense only sound pressures that are above the absolute audible threshold value. Also, a low sound pressure frequency component which is located in the vicinity of a high sound pressure frequency component (i.e., a masker) can not be sensed due to the influence of the Mask (i.e., masking effect). The masking effect has an asymmetrical characteristic on the opposite sides of the masker, and it is provided in a wider range on the lower frequency side of the masker rather than the high frequency side. It is thus possible to make efficient coding by making bit assignment to frequency components above the corrected audible threshold value in correspondence to the difference between the sound pressure and corrected audible threshold value of these frequency components.

In the adaptive transform coding system, a plurality of samples are subjected as a block to the linear transform. Usually, increasing the block length for linear transform permits increased resolution to be obtained to improve the coding quality. It is made clear, however, that the linear transform executed with a large block length on a sharp amplitude rise portion of the speech signal, results in generation of preceding noise or commonly called pre-echo when the coded speech signal is decoded. This is attributable to noise generation in a portion of one block in which the signal amplitude is changed sharply, that is, to the fact that the quantization distortion uniformly distributing in one block is sensed in a small signal amplitude portion.

It is well known in the art the pre-echo is closely related to the masking of time domain. FIGS. 4(A) to 4(C) show how pre-echo varies with the block length in the linear transform when drums are used as sound source for measurement. FIG. 4(A) shows the original waveform. This original waveform was coded through the linear transform with the block length N set to N=258 and N=1,024 and then decoded to obtain waveforms as shown in FIGS. 4(B) and 4(C), respectively. As is seen, noise is generated prior to a sharp signal amplitude rise portion (i.e., attack portion). This noise, i.e., the pre-echo is shorter with N=1,024 than with N=258, and it is obvious that linear transform with small block length is effective for the pre-echo suppression.

However, it is a fact that adopting short block leads to such inconvenience as deterioration of the resolution or reduction of the coding efficiency. In addition, actually quantized signals require one set of correction data for each block. This means that the greater the block length adopted the more number of correction data pieces can be dispensed to obtain higher efficiency. In order to meet such opposite demands arising from the pre-echo, it is desirable to allow switching of the block length as desired. An adaptive block length coding system is generally used to meet the above demands.

A standard algorithm used for the adaptive block length coding, adopts a three hierarchy layer structure in correspondence to such factor as the coding quality required for the adopted bit rate or the complexity of the system. In this case, layer III seeks coding quality improvement compared to layers I and II. The layer III utilizes adaptive block length for suppressing the pre-echo when each sub-band signal of the input signal is converted into the frequency domain through MDCT (modified discrete cosine transform).

In the MDCT system, a filtering operation with window function is executed by providing a 50% overlap between adjacent blocks lest discontinuity of quantized noise should be sensed as block distortion in the neighborhood of block boundaries. In addition, an off-set is introduced into the time term of discrete cosine transform which is calculated subsequently to obtain symmetrical transform coefficients. With this arrangement, the transform coefficients requiring coding become one half the overlapped block length 2N, thus permitting off-setting of the efficiency deterioration resulting from the 50% overlap. The basic concept of the adaptive block length introduced into the MDCT system, is based on a psychoacoustic model.

A speech coding system based on this concept is shown in FIG. 5. The speech coding system comprises a linear transform unit 50 for executing linear transform of an input signal Si with a predetermined block length, an FFT unit 60 for executing Fast Fourier transform of the input signal Si with two different block lengths, a block length setting unit 70 for calculating a predetermined block length Sb to be set in the linear transform unit 50 according to an FFT signal produced by the FFT unit 60 and setting this block length Sb in the linear transform unit 50, and a coding unit 80 for coding an intermediate signal Sm produced by the linear transform unit 50 to form and output a bit stream So. The operation timing of the individual units is controlled by a control unit (not shown).

The linear transform unit 50 includes a filter bank circuit 51 for dividing the input signal Si into a plurality of sub-bands, an MDCT circuit 52 for executing modified discrete cosine transform of the output signal from the filter band circuit 51 with the block length Sb, and a butterfly circuit 53 for removing fold-back distortion from the output signal of the MDCT circuit 52 to output the intermediate signal Sm.

The FFT unit 60 includes a first FFT circuit 61 for executing Fast Fourier transform of the input signal Si with a small block length to output an FFT signal Sf, and a second FFT circuit 62 for executing the Fast Fourier transform of the input signal Si with a large block length to output an FFT signal. The operations of the first and second FFT circuits 61 and 62 are controlled on a time division basis by the control unit noted above.

The block length setting unit 70 includes a predictability measuring circuit 71 for measuring predictability from the FFT signals, a signal/mask ratio calculating circuit 72 for calculating signal/mask ratio from the output signal of the predictability measuring circuit 71, and a psychoacoustic entropy evaluating circuit 73 for setting the block length Sb in the MDCT circuit 52 according to the output signal of the signal/mask ratio calculating circuit 72.

The coding unit 80 includes a non-linear transform circuit 81 for executing non-linear quantization of the intermediate signal Sm, a Huffman coding circuit 82 for coding the output signal of the non-linear transform circuit 81, and a bit stream forming circuit 83 for forming and outputting the bit stream So according to the coded signal output of the Huffman coding circuit 82 and side data from a side data coding circuit 86. The bit stream forming circuit 83 has a CRC check function. Reference numeral 85 designates a scale factor calculating circuit, and 84 buffer control circuit.

The speech signal (i.e., input signal) Si input to the system is divided in the filter bank circuit 51 into a plurality of sub-bands, which are fed to the MDCT circuit 52. The signal Si is also fed to the FFT unit 60 for Fast Fourier transform in the first and second FFT circuits 61 and 62 providing different block lengths. The block length setting unit 52 then provides psychoacoustic entropy evaluation according to the pair FFT signals and sets the block length Sb in the MDCT circuit 52.

More specifically, the predictability measuring circuit 71 in the block length setting unit 70 executes comparison, for each FFT signal (FFT spectral line), of the present value and predicted value obtained from data of the past two blocks, and measures the predictability from the amplitude and phase differences. Here, what the Euclid distance between the present and predicted values is standardized is referred to as caos index, and a caos index range of 0.5 to 0.05 is made to correspond to a pure speech index range of 0 to 1.The amplitude in the frequency band is converted to one-third threshold band energy expression for convolution calculation with respect to internal acoustic meatus spread function. A noise level which is just masked is calculated by using spectrum obtained by the convolution calculation and pure sound index.

The signal/mask ratio calculating circuit 72 calculates the signal/mask ratio SMRsb(n) in a sub-band n as:

$$SMRsb(n)=Lsb(n)-LTmin(n) \quad (1)$$

where Lsb(n) represents the sound pressure in the sub-band n, and LTmin(n) represents the minimum Masking level in the sub-band n.

In the vicinity of the attack where the pre-echo is generated, a sharp change in the time domain signal causes high frequency component increase and also causes power concentration degree reduction to increase the number of necessary bits. The psychoacoustic entropy evaluating circuit 73 grasps this phenomenon and, when the psychoacoustic entropy exceeds a predetermined threshold value, it determines the pertinent part of speech signal to be the attack part and sets a "small" block length Sb in the MDCT circuit 52, while setting a "large" block length Sb when the entropy is below the threshold value, thus permitting high coding quality and high resolution to be obtained.

When the MDCT circuit 52 executes a small block length process, the output signal of the filter bank circuit 51 consists of 6 frequency samples by 3 small blocks, i.e., 18 samples, per granule. 12 samples as a combination of the first 6 samples and the last 6 samples in the preceding granule, are dealt with as one block for the modified discrete cosine transform. Since the modified discrete cosine transform has coefficient symmetricity, the resultant output is reduced one half the input samples, i.e., 6 samples, and the small block as a whole consists of 6×3=18 frequency samples. When the circuit 52 executes a large block process, the output signal of the filter bank circuit 51 consists of 18 samples per granule, and its combination with the preceding granule, consisting of 38 samples, is dealt with one block for the modified discrete cosine transform. Again in this case, the independent output consists one half the input frequency samples, i.e., 18 samples, because of the coefficient symmetricity of the modified discrete cosine transform.

The speech signal that has been obtained as a result of the modified discrete cosine transform in the MDCT circuit 52, is input to the butterfly circuit 53. The butterfly circuit 53 executes a butterfly calculation by receiving 8 samples among the samples that are found near the boundaries of adjoining 32 bands of the overlap multi-layer filter bank output to remove fold-back distortion in the frequency domain. The filter bank circuit 51, MDCT circuit 52 and butterfly circuit 53 provide for copying with combination of filter bank and orthogonal transform, and their frequency resolution is elevated to 18 times that of the layers I and II.

The intermediate signal Sm output from the linear transform unit 50 is inputted to the coding unit 80. The coding unit 80 executes a non-linear quantization of the signal according to the bit assignment based on the psychoacoustic model, and effects bit distribution exceeding the frame boundary in the time domain. The quantized signal thus obtained is coded in the Huffman coding circuit 82 to be assembled in the frame for forming a bit stream together with the side data supplied from the side data coding circuit 86. The bit stream thus formed is subjected to a CRC check before being sent out to a transmission line or stored in a storage medium. In the bit stream structure of the layer III, each frame consists of 1,152 samples, and it is divided into two granules each of 576 samples.

The above prior art example has disadvantages that large amounts of calculations are dictated in the FFT unit and block length setting unit and that considerable time is taken from the input of the speech signal till the output of the bit stream, thus resulting in low processing capacity of the system as a whole. One method for improving the processing capacity is shown in Japanese Patent Laid-Open Publication Heisei 4-302540. This method attempts to improve the processing capacity by determining the block length and the floating coefficient with the same index. In such method, however, block length switching is executed by selecting a large or a small block according to the result of comparison between a pair of a large block and a small block which is one half the large block with respect of the maximum absolute values. In this method it is necessary to calculate and compare the maximum absolute value in each of a plurality of small blocks as divisions of the large block. This has an inconvenience that the burden of calculations is increased with increasing number of block divisions.

SUMMARY OF THE INVENTION

An object of the present invention is therefore to provide a speech coding system which improves the above inconveniences inherent in the prior art example with the improvement of the processing capacity.

The inventor analyzed the actual signal processing in the FFT unit and block length setting unit and found the fact that it is with only sounds generated by very limited sound sources such as drums or castanets that the processing result in a small block length FFT circuit is made use of in the psychoacoustic entropy evaluation and that FFT execution in the small block length FFT circuit is wasteful in many cases. The present invention is predicated in these findings, and its constitution is as follows.

According to one aspect of the present invention, there is provided a speech coding system comprising a linear transform unit for executing linear transform on an input signal with a predetermined block length, an FFT unit for executing Fast Fourier transform on the input signal with two different, i.e., large and small, block lengths, a block length setting unit for calculating a predetermined block length to be set in the linear transform unit according to an FFT signal obtained in the FFT unit and setting this block length in the linear transform unit, and a coding unit for coding an intermediate signal generated in the linear transform unit to form and output a bit stream, wherein the FFT unit having an FFT selecting function of selecting the block length used for the Fast Fourier transform among the large and small block lengths according to the gain difference of a continuous portion of the input signal.

The block setting unit has a function of calculating the predetermined block length to be set in the linear transform unit according to the FFT signal obtained through Fast Fourier transform when the FFT unit executes the Fast Fourier transform with only a single block length.

The linear transform unit includes a modified discrete cosine transform circuit for executing linear transform of the input signal.

The block length setting unit calculates a block length to be set in the linear transform unit according to psychoacoustic entropy evaluation.

The FFT unit includes a first FFT circuit for executing FFT on the input signal Si with a small block length, a second FFT circuit for executing FFT on the input signal SI with a large block length, a gain calculating circuit for calculating a gain from an FFT signal output from the second FFT circuit, and an FFT selecting means for selectively outputting the input signal to the first FFT circuit based on the gain outputted from the gain calculating circuit, and the block length setting unit includes an predictability calculating circuit for executing the calculation of the predictability with respect to the output of each of the first and second FFT circuits, a signal/mask ratio calculating circuit for calculating the signal/mask ratio from the output of the predictability calculating circuit, and a psychoacoustic entropy evaluating circuit for executing psychoacoustic entropy evaluation from the output of the signal/mask ratio calculating circuit and setting the predetermined block length according to the evaluation result.

The FFT selecting means makes prediction according to the speech gain of the preceding frame as to whether it is possible to mask pre-echo, and if it is predicted that it is impossible to mask the pre-echo, FFT is executed in both of the first and second FFT circuits and if it is predicted that it is possible to mask the pre-echo, the input signal is outputted to the second FFT circuit only and not to the first FFT circuit.

The FFT selecting means judges the speech gain of the preceding frame supplied by the gain calculating circuit with respect of the threshold value, and according to the judgment result selects either both of the first and second FFT circuits or the sole second FFT circuit; the gain calculating circuit calculates the speech gain from the FFT signal outputted from the second FFT circuit, and informs the result to the FFT selecting means; the predictability calculating circuit executes predictability calculation with respect to each FFT signal, and determines either of the FFT signals of the first and second FFT circuits, which the signal/mask ratio is to be calculated with respect to, when FFT is executed in both the first and second FFT circuits, and when FFT is executed in the sole second FFT circuit, the FFT signal from the second FFT circuit is directly inputted to the signal/mask ratio calculating circuit without execution of the predictability calculation; the signal/mask ratio calculating circuit executes the signal/mask ratio with respect to specified FFT signal according to the result of the predictability calculation; and the psychoacoustic entropy evaluating circuit executes the psychoacoustic entropy evaluation according to the output of the signal/mask ratio calculating circuit, and sets the predetermined block length according to the result of the evaluation.

The FFT unit may include a first memory for tentatively storing the input signal, a first FFT circuit for executing Fast Fourier transform on the input signal with a small block length, a second FFT circuit for executing Fast Fourier transform on the input signal with a large block length, and a gain comparator, having a second memory, for comparing continuous portion of the FFT signal output of the second FFT circuit.

By the term "psychoacoustic entropy evaluation" is meant evaluation which has such a content as to provide a decision to execute a linear transform on a small block with a small number of samples when the psychoacoustic entropy exceeds a predetermined threshold value and provide a decision to execute a linear transform on a large block with a large number of samples.

According to the present invention, when the gain difference of continuous signal (or frame) of the input signal is above a predetermined value, FFT (Fast Fourier Transform) with a large block length and that with a small block length are both executed on the same signal subject by an FFT selecting function in the FFT unit. When the gain difference of continuous signal of the input signal is below the predetermined value, only the FFT with the large block length is executed by the FFT selecting function in the FFT unit.

Further, according to the present invention, when the FFT with the large block length is executed in the FFT unit, the block length setting unit calculates the signal/mask ratio with respect to the pertinent FFT signal without measuring the predictability, and a predetermined block length is set in the linear transform unit according to the result of the calculation.

Other objects and features of the present invention will be clarified from the following description with reference to attached drawings.

DETAILED DESCRIPTION OF THE PREFERRED EMBODIMENTS

Figure 1:
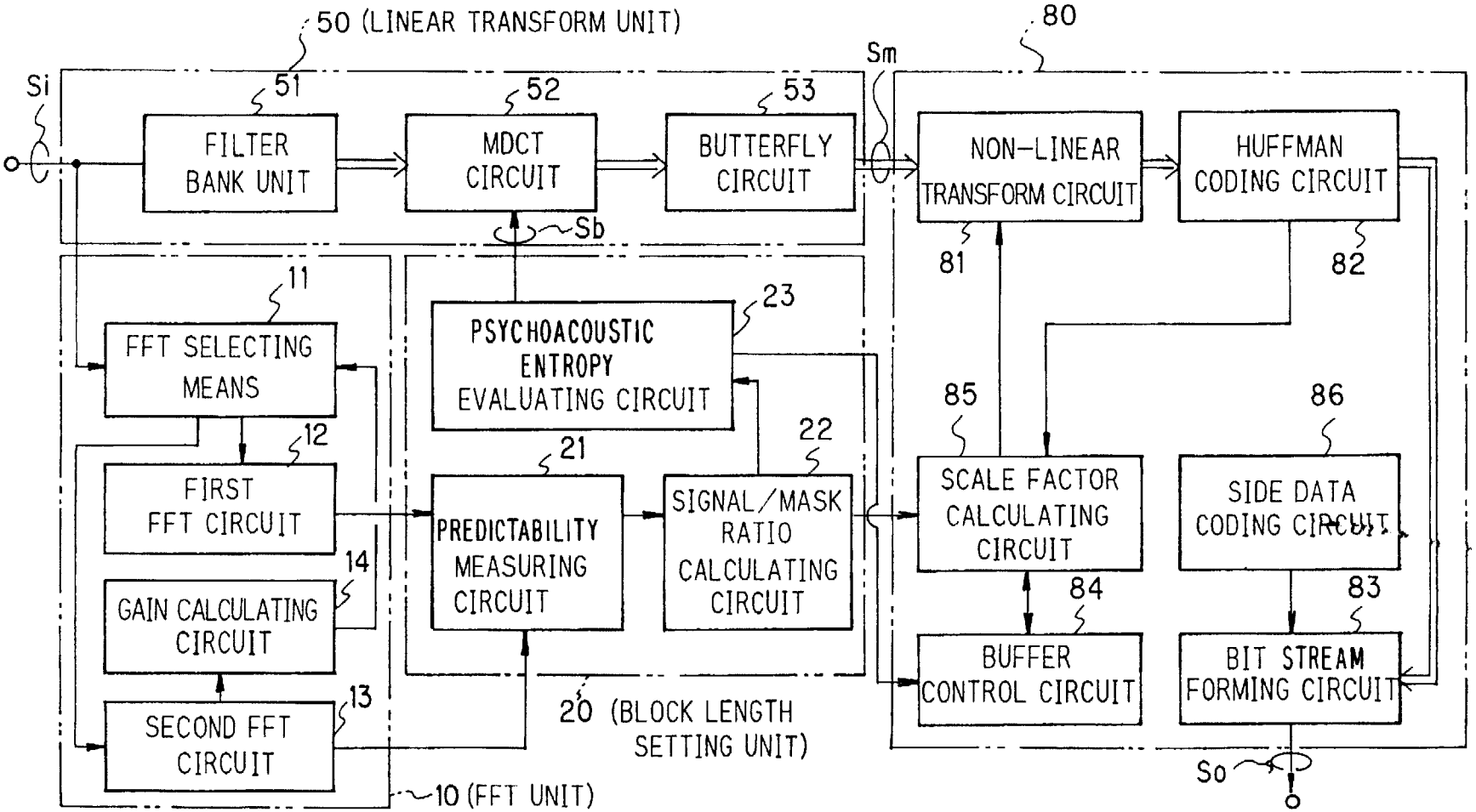
FIG. 1 shows a speech coding system according to the present invention.
Figure 5:
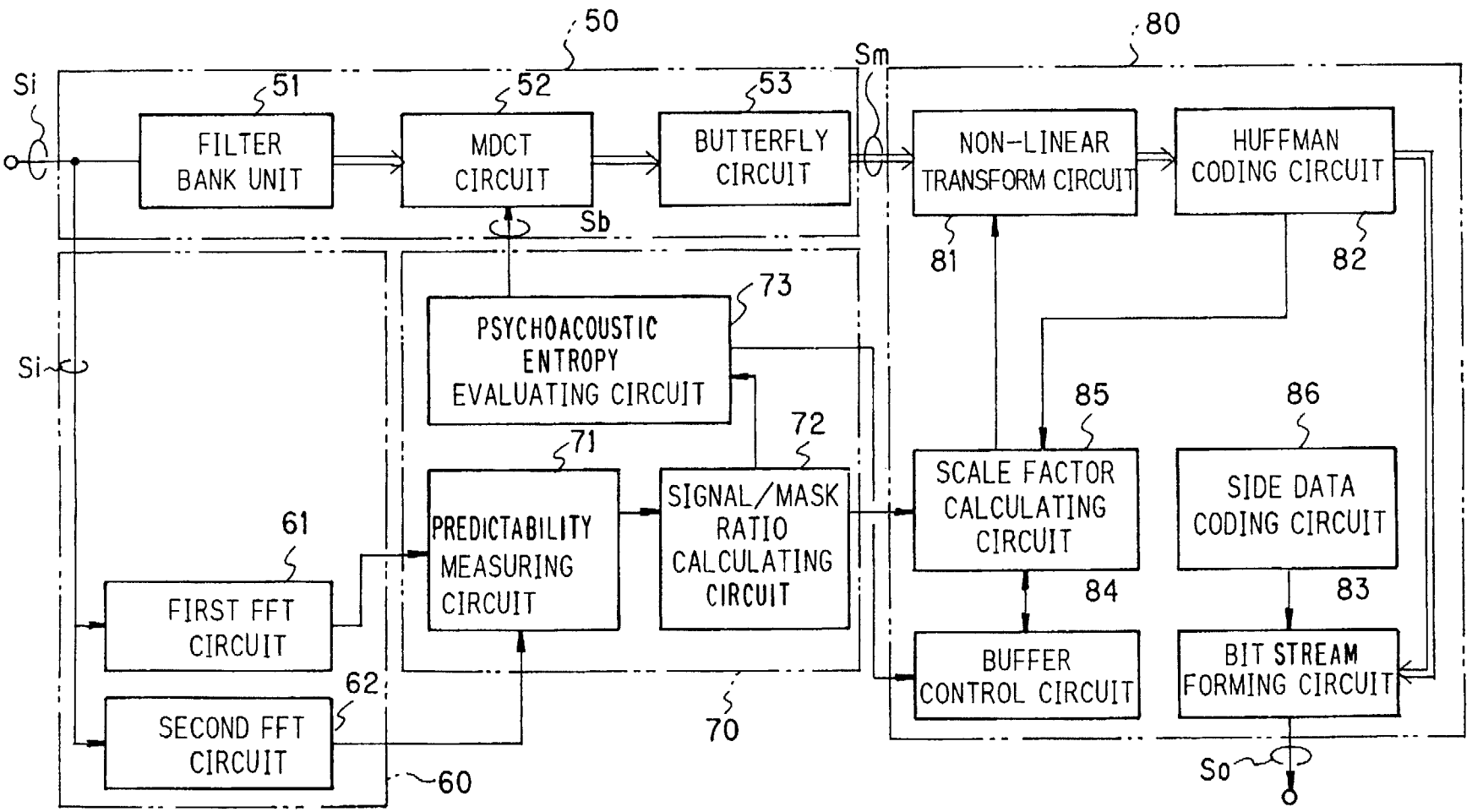
FIG. 5 PRIOR ART
FIG. 5 shows a prior art speech coding system.

The speech coding system as shown in FIG. 1 comprises a linear transform unit 50 for executing a linear transform on an input signal Si with a predetermined block length, and an FFT unit 10 for executing Fast Fourier transforms on the input signal Si with two different, i.e., large and small, block lengths. The system further comprises a block length setting unit 20 for calculating a block length Sb to be set in the linear transform unit 50 based on an FFT signal produced in the FFT unit 10 and set this block 5b in the linear transform unit 50, and a coding unit 80 for coding the intermediate signal Sb produced in the linear transform unit 50 to form and output a bit stream. The FFT unit 10 has an FFT selecting function to select a block length used for FFT (Fast Fourier transform) among two different, i.e., large and small, block lengths based on the gain difference of continuous signal of the input signal Si. The input signal Si is the speech signal which has been obtained after linear quantization executed in advance. The linear transform unit 50 and coding unit 8 have the same structures as in the Prior art example shown in FIG. 5, and they are designated by like reference numerals while providing no repeated description.

The FFT unit 10 includes a first FFT circuit 12 for executing FFT on the input signal Si with a small block length, a second FFT circuit 13 for executing FFT on the input signal SI with a large block length, a gain calculating circuit 14 for calculating a gain from an FFT signal output from the second FFT circuit 13 and an FFT selecting means 11 for selectively outputting the input signal Si to the first FFT circuit 12 based on the gain outputted from the gain calculating circuit 14. The gain calculating circuit 14 has a function of calculating the speech gain from the output of the second FFT circuit 13 for each frame and supplying the calculation result to the FFT selecting means 11.

The FFT selecting means 11 selects execution of FFT on the input signal Si in both the first and second FFT circuits 12 and 13 or execution of FFT in only the second FFT circuit 13 according to the magnitude of the speech gain of the preceding frame supplied from the gain calculating circuit 14.

The block length setting unit 20 includes an predictability calculating circuit 21 for executing the calculation of the predictability with respect to the output of each of the FFT circuits 12 and 13, a signal/mask ratio calculating circuit 22 for calculating the signal/mask ratio from the output of the predictability calculating circuit 21, and a psychoacoustic entropy evaluating circuit 23 for executing psychoacoustic entropy evaluation from the output of the signal/mask ratio calculating circuit 22 and setting a predetermined block length in the MDCT circuit 52 according to the evaluation result.

The selecting process in the FFT selecting means 11 has an aim of pre-echo removal. It makes prediction according to the speech gain of the preceding frame as to whether it is possible to mask the pre-echo. If it is predicted that it is impossible to mask the pre-echo, FFT is executed in both of the first and second FFT circuits 12 and 13. If it is predicted that it is possible to mask the pre-echo, the input signal Si is outputted to the second FFT circuit 13 only and not to the first FFT circuit 12.

Figure 2:
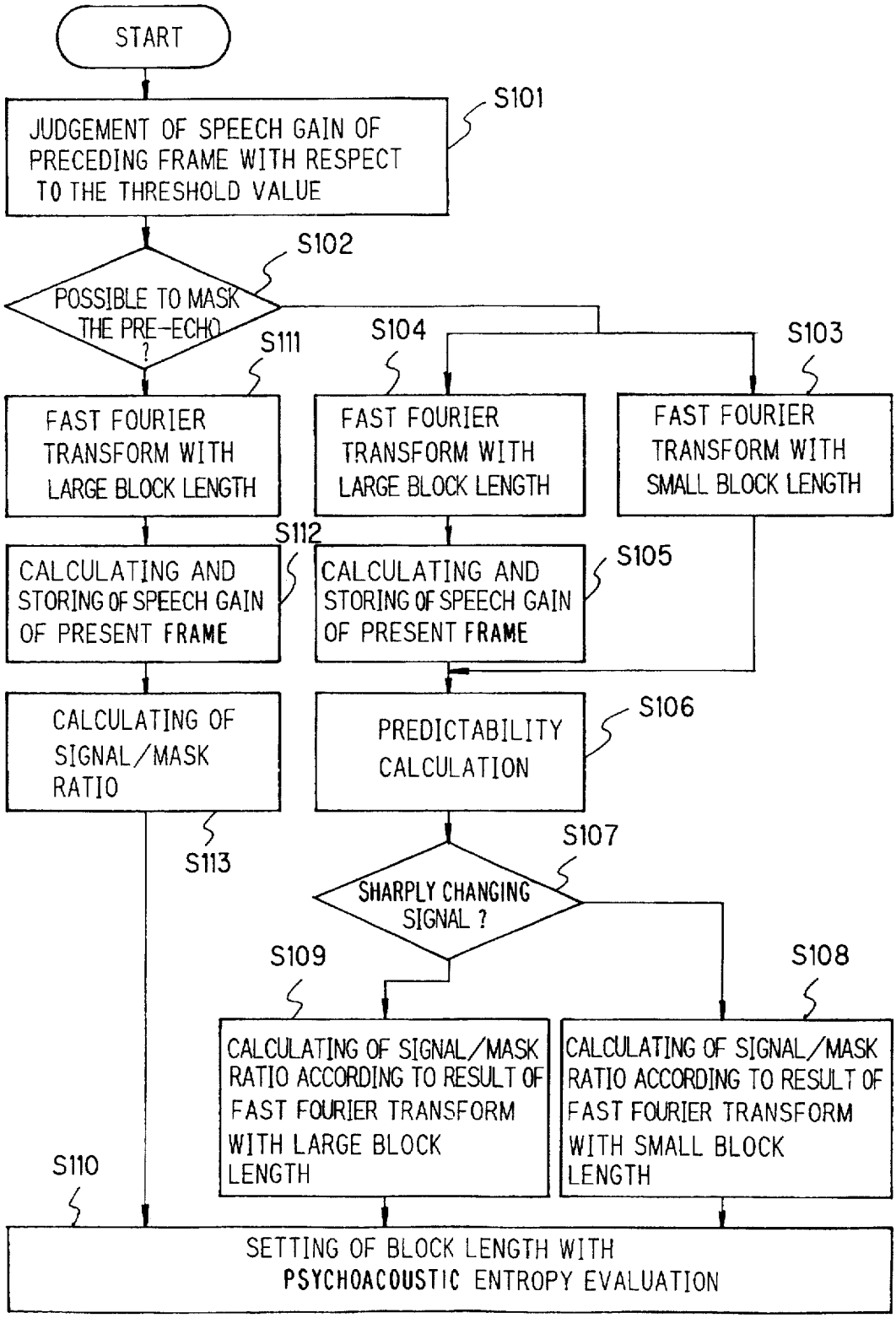
FIG. 2 shows an operation of the system of FIG. 1.

Now, the operation of the system including the pertinent process will be described with reference to FIG. 2.

(1) The FFT selecting means 11 judges the speech gain of the preceding frame supplied by the gain calculating circuit 14 with respect of the threshold value, and according to the judgment result it selects either both of the first and second FFT circuits 12 and 13 or the sole second FFT circuit 13, to which the input signal Si is to be outputted (steps S101 and S102). In this stage, determination as to whether it is possible to mask the pre-echo generated in the decoded signal is made under prediction.

(2) The FFT selecting means 11 outputs the input signal Si to the FFT circuits or circuit selected in (1). The FFT circuits or circuit receiving the input signal Si execute or executes FFT operation and the executed signals or signal are or is outputted (steps S103, S104 and S111). Each FFT process is executed on a time division basis under control of the DSP.

(3) The gain calculating circuit 14 calculates the speech gain from the FFT signal outputted from the second FFT circuit 13, and informs the result to the FFT selecting means 11 (steps S105 and S112).

(4) When FFT is executed in both the first and second FFT circuits 12 and 13, the predictability calculating circuit 21 executes predictability measurement (calculation) with respect to each FFT signal, and determines either of the FFT signals of the first and second FFT circuits 12 and 13, which the signal/mask ratio is to be calculated with respect to. In this stage, a judgment is made as to whether the input signal Si is a sharply changing signal (step S107). When FFT is executed in the sole second FFT circuit 13, the FFT signal from the second FFT circuit 13 is directly inputted to the signal/mask ratio calculating circuit 22 without execution of the predictability calculation (step S113).

(5) The signal/mask ratio calculating circuit 22 executes the signal/mask ratio with respect to specified FFT signal according to the result of the predictability calculation in (4) (steps S108 and s109).

(6) The psychoacoustic entropy evaluating circuit 23 executes the psychoacoustic entropy evaluation according to the output of the signal/mask ratio calculating circuit 22, and sets a predetermined block length Sb in the MDCT circuit 52 according to the result of the evaluation (step S110).

The input signal Si undergoes the modified discrete cosine transform with the block length set in the MDCT circuit 52 before being inputted to the coding unit 80 to be formed into a bit stream which is outputted.

Figure 3:
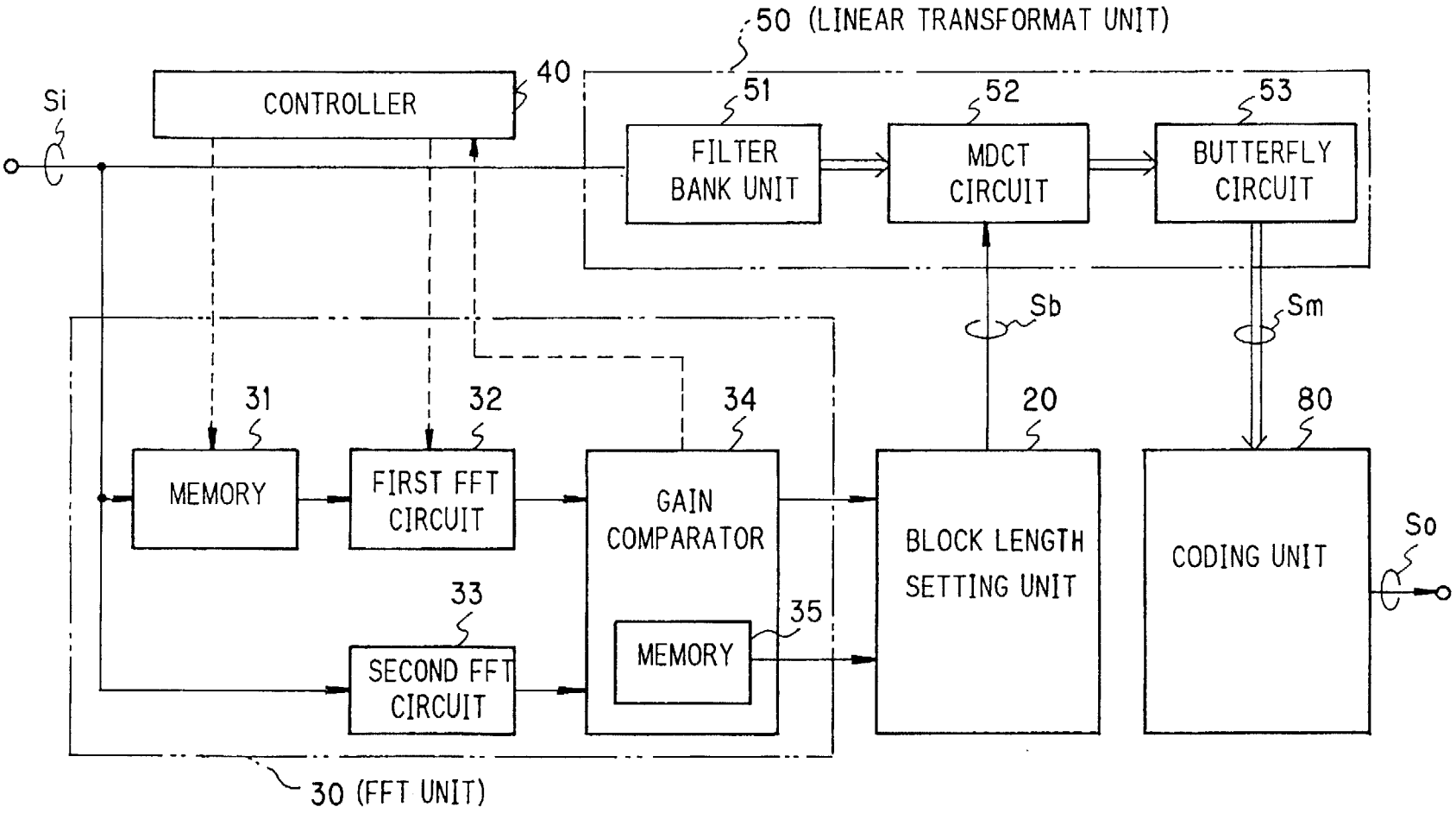
FIG. 3 shows a speech coding system according to another embodiment of the present invention.
Figure 4A:
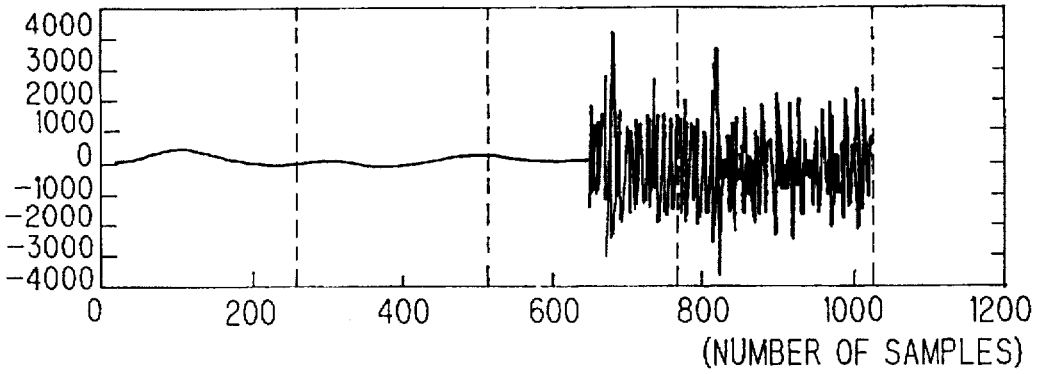
FIG. 4A PRIOR ART
FIGS. 4(A) to 4(C) show how pre-echo varies with the block length in the linear transform when drums are used as sound source for measurement.
Figure 4B:
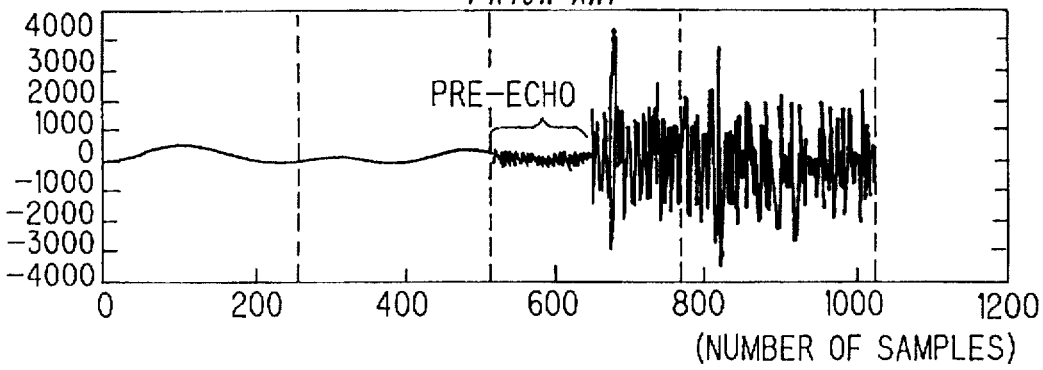
FIG. 4B PRIOR ART
Figure 4C:
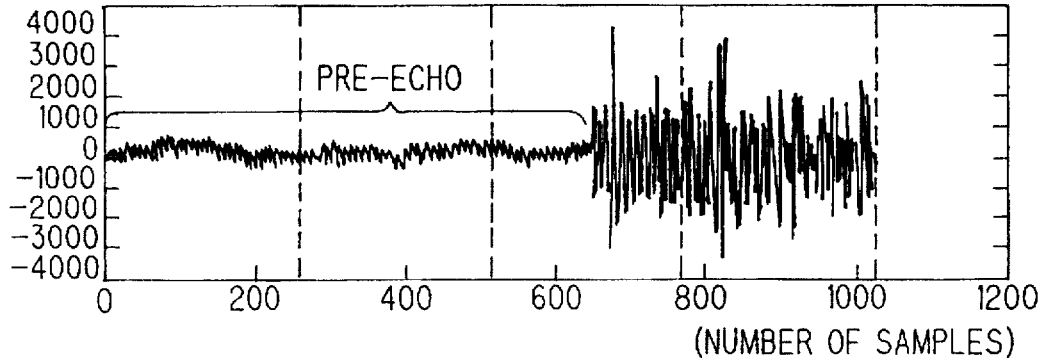
FIG. 4C PRIOR ART

Another embodiment of the present invention will now be described with reference to FIG. 3. This FIG. 3 embodiment is the same as the preceding embodiment except for the structure of FFT unit 30. Parts like those in the preceding embodiment are designated by like reference numerals and given no repeated description. The structure of the FFT unit 30 will now be described.

The FFT unit 30 includes a memory 31 for tentatively storing an input signal Si, a first FFT circuit 32 for executing Fast Fourier transform on the input signal Si with a small block length, a second FFT circuit 33 for executing Fast Fourier transform on the input signal Si with a large block length, a gain comparator 34 for comparing continuous portion of the FFT signal output of the second FFT circuit 33. The gain comparator 34 has an internal memory 35 for tentatively storing the FFT signal. The operation timings of these constituent elements are controlled by a controller 40 which controls the operation of the entire system. Dashed lines in FIG. 3 show the flow of control signal, but the illustration is partly omitted.

In this embodiment, the memory 31 is a RAM (random access memory) having a capacity sufficient to store at least two frames of the input signal Si. The first and second FFT circuits 32 and 33 are actually constituted by a DSP (digital signal processor) to execute the processes on a time division basis. The gain comparator 34 has means for calculating a gain from the FFT signal calculated by the second FFT circuit 33, and means for comparing continuous part of the pertinent gain and threshold judging the resultant difference. The memory 35 in the gain comparator 34 is a RAM having a capacity needed for storing at least three frames of the FFT signal. The gain comparator 34 further has a function of causing the operations of the memory 31 and first FFT circuit (i.e., small block length FFT circuit) 32 via the controller 40 according to the result of the threshold gain judgment noted above. In the FFT unit 30, the FFT selecting function is realized by the combination of these functions.

Operation that is brought about when the input signal Si is inputted is as follows.

(11) The input signal Si is inputted to the linear transform unit 50, memory 31 and second FFT circuit 33. The input signal Si inputted to the linear transform unit 50 is tentatively stored in an internal memory (not shown).

(12) The FFT circuit 33 executes the large block length FFT on two continuous frames of the input signal. During this time, two frames of the input signal Si are stored in the memory 31.

(13) In the gain comparator 34, two frames of the FFT signal from the second FFT circuit 33 are stored in the memory 35.

(14) The gain comparator 34 calculates the gain with respect to each FFT signal stored in the memory 35 and, if the gain difference is above a predetermined value (i.e., threshold value), requests the output of the input signal Si that has been stored in the memory 31 to the first FFT circuit 32 via the controller 40. In case of the gain difference below the predetermined value, the preceding frame having been stored in the memory 35 is outputted to the block length setting unit 20, and at the same time the preceding frame having been stored in the memory 31 is removed.

(15) When the memory 31 receives a signal output command from the controller 40, the preceding frame having been stored in the memory 31 is inputted to the first FFT circuit 32 for executing the small block length FFT. The FFT signal that is obtained as a result is stored in the memory 35 of the gain comparator 34.

(16) When the FFT signal based on the large block length and that based on the small block length have been stored in the memory 35, each FFT signal is inputted to the block length setting unit 20.

(17) When the sole FFRT signal based on the large block length is inputted, the block length setting unit 20 calculates the signal/mask ratio with respect to this signal, and then sets the block length calculated by the psychoacoustic entropy calculation in the MDCT circuit 2 of the linear transform unit 50. When both the FFT signals based on the large and small lengths are inputted, the signal/mask ratio is calculated through predictability measurement with respect to these input signals for setting a block length calculated through the psychoacoustic entropy calculation in the MDCT circuit 52.

(18) The input signal Si inputted to the linear transform unit 50 is subjected to the modified discrete cosine transform with the block length Sb set in the MDCT circuit 52 before being formed in the coding unit 80 into a bit stream.

(19) Subsequently, the process from the step (11) is executed repeatedly by shifting the subject of processing frame by frame.

As has been described, in the above embodiment the small block length FFT is executed, only when the input signal gain difference is changed by more than a predetermined amount, that is, only when there is a possibility of the pre-echo generation. Thus, unlike the prior art case, there is no possibility of execution of the small block length FFT even with respect to signal without sharp gain change, such as tone color of the flute or the like. It is thus possible to reduce the overall calculation amount necessary for the speech coding while maintaining a comparable speech resolution to that in the prior art, thus permitting processing capacity improvement of the system.

In addition, the block length setting unit 3 executes the predictability measurement only when the FFT is executed with both the large and small block lengths in the FFT unit 2 and does not when only the large block length FFT is executed. Further calculation amount reduction is thus possible to permit further processing capacity improvement of the system.

As has been described in the foregoing, according to the present invention an FFT unit is provided, which has an FFT selecting function of selecting the block length used for FFT according to the input signal gain difference. Thus, the small block length FFT is executed only when the input signal gain difference is changed by more than a predetermined value, that is, only when there is a possibility of pre-echo generation, and unlike the prior art there is no possibility of execution of the small block length FFT even with respect to signal without sharp gain change, such as tone color of the flute or the like. It is thus possible to provide an excellent speech coding system unseen in the prior art, which permits reduction of the overall calculation amount necessary for speech coding while maintaining a comparable speech resolution to that in the prior art, thus permitting processing capacity improvement of the system.

The block length setting unit executes predictability measurement only when both of the large block length FFT and small block length FFT are executed in the FFT unit and does not when the sole large block length FFT is executed, thus permitting further calculation amount reduction to further improve the processing capacity of the system.

The linear transform of the input signal is executed in the MDCT (modified discrete cosine transform) circuit. This means that it is necessary to execute quantization of only one half the samples as the subject of the transform, which is advantageous for the processing capacity improvement of the system. In addition, it is possible to avoid discontinuity of quantized noise in the vicinity of block boundaries, which is fatal to the block coding. Thus, where a coding system is adopted, in which signal overlap is produced after multiplying the input signal by a window function, it is possible to cancel efficiency deterioration due to the overlap.

Changes in construction will occur to those skilled in the art and various apparently different modifications and embodiments may be made without departing from the scope of the invention. The matter set forth in the foregoing description and accompanying drawings is offered by way of illustration only. It is therefore intended that the foregoing description be regarded as illustrative rather than limiting.

What is claimed is:

1. A speech coding system comprising a linear transform unit for executing linear transform on an input signal with a predetermined block length, an FFT unit for executing Fast Fourier transform on the input signal with large and small, block lengths, a block length setting unit for calculating a predetermined block length to be set in the linear transform unit according to an FFT signal obtained in the FFT unit and setting the block length in the linear transform unit, and a coding unit for coding an intermediate signal generated in the linear transform unit to form and output a bit stream, wherein the FFT unit having an FFT selecting function of selecting the block length used for the Fast Fourier transform among the large and small block lengths according to the gain difference of a continuous portion of the input signal.

2. The speech coding system according to claim 1, wherein the block setting unit has a function of calculating the predetermined block length to be set in the linear transform unit according to the FFT signal obtained through Fast Fourier transform when the FFT unit executes the Fast Fourier transform with only a single block length.

3. The speech coding system according to claim 2, wherein the block length setting unit calculates a block length to be set in the linear transform unit according to psychoacoustic entropy evaluation.

4. The speech coding system according to claim 2, wherein the linear transform unit includes a modified discrete cosine transform circuit for executing linear transform of the input signal.

5. The speech coding system according to claim 1, wherein the linear transform unit includes a modified discrete cosine transform circuit for executing linear transform of the input signal.

6. The speech coding system according to claim 5, wherein the block length setting unit calculates a block length to be set in the linear transform unit according to psychoacoustic entropy evaluation.

7. The speech coding system according to claim 1, wherein the block length setting unit calculates a block length to be set in the linear transform unit according to psychoacoustic entropy evaluation.

8. The speech coding system according to claim 1, wherein said FFT unit includes a first FFT circuit for executing FFT on the input signal Si with a small block length, a second FFT circuit for executing FFT on the input signal SI with a large block length, a gain calculating circuit for calculating a gain from an FFT signal output from the second FFT circuit, and an FFT selecting means for selectively outputting the input signal to the first FFT circuit based on the gain outputted from the gain calculating circuit, and the block length setting unit includes an predictability calculating circuit for executing the calculation of the predictability with respect to the output of each of the first and second FFT circuits, a signal/mask ratio calculating circuit for calculating the signal/mask ratio from the output of the predictability calculating circuit, and a psychoacoustic entropy evaluating circuit for executing psychoacoustic entropy evaluation from the output of the signal/mask ratio calculating circuit and setting the predetermined block length according to the evaluation result.

9. The speech coding system according to claim 8, wherein said FFT selecting means makes prediction according to the speech gain of the preceding frame as to whether it is possible to mask pre-echo, and if it is predicted that the pre-echo can not be masked, FFT is executed in both of the first and second FFT circuits and if it is predicted that it is possible to mask the pre-echo, the input signal is outputted to the second FFT circuit only and not to the first FFT circuit.

10. The speech coding system according to claim 9, wherein said FFT selecting means judges the speech gain of the preceding frame supplied by the gain calculating circuit with respect to the threshold value, and according to the judgement result selects either both of the first and second FFT circuits or the sole second FFT circuit;

said gain calculating circuit calculates the speech gain from the FFT signal outputted from the second FFT circuit, and informs the result to the FFT selecting means;

said predictability calculating circuit executes predictability calculation with respect to each FFT signal, and determines either of the FFT signals of the first and second FFT circuits, which the signal/mask ratio is to be calculated with respect to, when FFT is executed in both the first and second FFT circuits, and when FFT is executed in the sole second FFT circuit, the FFT signal from the second FFT circuit is directly inputted to the signal/mask ratio calculating circuit without execution of the predictability calculation;

said signal/mask ratio calculating circuit executes the signal/mask ration with respect to specified FFT signal according to the result of the predictability calculation; and said psychoacoustic entropy evaluating circuit executes the psychoacoustic entropy evaluation according to the output of the signal/mask ratio calculating circuit, and sets the predetermined block length according to the result of the evaluation.

11. The speech coding system according to claim 1, wherein said FFT unit includes a first memory for tentatively storing the input signal, a first FFT circuit for executing Fast Fourier transform on the input signal with a small block length, a second FFT circuit for executing Fast Fourier transform on the input signal with a large block length, and a gain comparator, having a second memory, for comparing continuous portion of the FFT signal output of the second FFT circuit.

12. The speech coding system according to claim 11, wherein said memory is a RAM having a capacity sufficient to store at least two frames of the input signal, the first and second FFT circuits are actually constituted by a digital signal processor to execute the processes on a time division basis, and the gain comparator has means for calculating a gain from the FFT signal calculated by the second FFT circuit and means for comparing continuous part of the pertinent gain and threshold judging the resultant difference.

13. The speech coding system according to claim 11, wherein the input signal is inputted to the linear transform unit, first memory and second FFT circuit;

the FFT circuit executes the large block length FFT on two continuous frames of the input signal which are to be stored in the second memory;

in the gain comparator, two frames of the FFT signal from the second FFT circuit are stored in the second memory;

the gain comparator calculates the gain with respect to each FFT signal stored in the second memory and, if the gain difference is above a predetermined value, requests the output of the input signal that has been stored in the first memory to the first FFT circuit, and if the gain difference is below the predetermined value, the preceding frame having been stored in the second memory is outputted to the block length setting unit, said block length setting unit, when the sole FFT signal based on the large block length is inputted, calculates the signal/mask ratio with respect to this signal, and then sets the block length calculated by the psychoacoustic entropy calculation of the linear transform unit, the signal/mask ratio is calculated through the predictability measurement with respect to these input signals for setting a block length calculated through the psychoacoustic entropy calculation when both the FFT signals based on the large and small lengths are inputted; and the input signal inputted to the linear transform unit is subjected to the modified discrete cosine transform with the block length before being formed in the coding unit into a bit stream.

* * * * *